US007159417B2

(12) United States Patent
Foglietta et al.

(10) Patent No.: US 7,159,417 B2
(45) Date of Patent: Jan. 9, 2007

(54) HYDROCARBON RECOVERY PROCESS UTILIZING ENHANCED REFLUX STREAMS

(75) Inventors: Jorge H. Foglietta, Missouri City, TX (US); Sanjiv N. Patel, Sugar Land, TX (US)

(73) Assignee: ABB Lummus Global, Inc., Houston, TX (US)

( * ) Notice: Subject to any disclaimer, the term of this patent is extended or adjusted under 35 U.S.C. 154(b) by 329 days.

(21) Appl. No.: 10/803,490

(22) Filed: Mar. 18, 2004

(65) Prior Publication Data

US 2005/0204774 A1 Sep. 22, 2005

(51) Int. Cl.
*F25J 3/00* (2006.01)

(52) U.S. Cl. ..... 62/625; 62/635; 62/630

(58) Field of Classification Search ..... 62/625, 62/628, 630, 635
See application file for complete search history.

(56) References Cited

U.S. PATENT DOCUMENTS

| | | | | |
|---|---|---|---|---|
| 4,171,964 | A | 10/1979 | Campbell | |
| 4,278,457 | A | 7/1981 | Campbell et al. | |
| 4,322,225 | A | 3/1982 | Bellinger | |
| 4,519,824 | A | 5/1985 | Huebel | |
| 4,559,070 | A * | 12/1985 | Sweet | 62/625 |
| 5,555,748 | A | 9/1996 | Campbell et al. | |
| 5,561,988 | A | 10/1996 | Mehra | |
| 5,953,935 | A | 9/1999 | Sorensen | |
| 5,983,664 | A | 11/1999 | Campbell et al. | |
| 6,182,469 | B1 | 2/2001 | Campbell et al. | |
| 6,244,070 | B1 * | 6/2001 | Lee et al. | 62/620 |
| 6,354,105 | B1 | 3/2002 | Lee et al. | |
| 2001/0052241 | A1 | 12/2001 | Jain | |
| 2002/0157538 | A1 * | 10/2002 | Foglietta et al. | 95/237 |
| 2003/0014995 | A1 | 1/2003 | Bowen et al. | |
| 2004/0148964 | A1 * | 8/2004 | Patel et al. | 62/620 |
| 2004/0172967 | A1 * | 9/2004 | Patel et al. | 62/620 |

FOREIGN PATENT DOCUMENTS

| | | |
|---|---|---|
| WO | WO03/095913 | 11/2003 |
| WO | WO2004/065868 | 8/2004 |
| WO | WO2004/076946 | 9/2004 |

OTHER PUBLICATIONS

Pitman R N et al; "Next Generation Processes for NGL/LPG Recovery"; Proceedings of the GPA Annual Convention, Tulsa, OK, US, Mar. 16, 1998; pp. 90-97, XP001106009, figs. 1,4.

* cited by examiner

*Primary Examiner*—William C. Doerrler
(74) *Attorney, Agent, or Firm*—Bracewell & Giuliani LLP

(57) ABSTRACT

A process and apparatus for the recovery of ethane and heavier components from a hydrocarbon feed gas stream. Feed gas stream is cooled and separated into a vapor stream and a condensed stream. Vapor stream is divided into a first and a second gas streams. First gas stream is expanded and sent to a fractionation tower. Second gas stream is supplied to an absorber tower. At least a part of the first liquid stream is cooled and sent to the absorber. Absorber column produces a lean vapor stream and a second condensed stream. Lean vapor stream is cooled and sent to the fractionation tower. Second condensed stream is subcooled and supplied to the fractionation tower. Temperatures and pressures of the streams and columns are maintained to recover a major portion of ethane and heavier hydrocarbon components as bottom product, and produce at the fractionation tower overhead, a residue gas stream.

28 Claims, 4 Drawing Sheets

HYDROCARBON RECOVERY PROCESS UTILIZING ENHANCED REFLUX STREAMS

TECHNICAL FIELD OF THE INVENTION

The present invention relates to the recovery of ethane and heavier components from hydrocarbon gas streams. More particularly, the present invention relates to the recovery of ethane and heavier components from hydrocarbon inlet gas streams using enhanced reflux streams.

BACKGROUND OF THE INVENTION

Valuable hydrocarbon components such as ethane, ethylene, propane, propylene, and heavier hydrocarbon components are present in a variety of gas streams, such as natural gas streams, refinery off gas streams, coal seam gas streams, and the like. These components can also be present in other sources of hydrocarbons, such as coal, tar sands, and crude oil. The amount of valuable hydrocarbons varies with the feed source. Generally, it is desirable to recover hydrocarbons or natural gas liquids (NGL) from gas streams containing more than fifty percent ethane, carbon dioxide, methane and lighter components, such as nitrogen, carbon monoxide, hydrogen, and the like. Propane, propylene and heavier hydrocarbon components generally make up a small amount of the inlet gas feed stream.

Several prior art processes exist for the recovery of NGL from hydrocarbon gas streams, such as oil absorption, refrigerated oil absorption, and cryogenic processes to name a few. Because the cryogenic processes are generally more economical to operate and more environmentally friendly, current technology generally favors the use of cryogenic gas processes over oil or refrigerated oil absorption processes. In particular, the use of turboexpanders in cryogenic gas processing is preferred, such as described in U.S. Pat. No. 4,278,457 issued to Campbell, as shown in FIG. 1.

Turboexpander recovery processes that also utilize residue recycle streams are capable of obtaining high ethane recoveries (in excess of 95%), while recovering essentially 100% of C3+ components. Such processes, though impressive in achieving high recoveries, consume relatively large quantities of energy due to their compression requirements. In order to reduce energy consumption while still maintaining high recoveries, an additional source of reflux is needed. It would be advantageous for such a reflux stream to be lean in desirable components, such as ethane and heavier components, and be available at a high pressure.

In many cryogenic recovery processes, efficiency is lost because of the quality of the fractionation tower overhead stream, which results in a reflux stream containing a considerable amount of C2+ components. Because the reflux stream has a considerable amount of C2+ components, any flash after a control valve on the reflux stream will lead to some vapor formation. The resulting vapor will have some amount of C2+ components that will escape the fractionation step and be lost in the overhead stream and subsequently in the residue gas stream. Additionally, equilibrium is reached at the top stage of the fractionation tower that allows more ethane to escape with the overhead stream.

It has been taught to use an absorber to generate lean reflux streams, such as in U.S. Pat. No. 6,244,070 issued to Lee et al. As described in Lee, vapor leaving the inlet separator is split three ways. The first vapor stream is cooled and introduced at the bottom of the absorber column. The second vapor stream is condensed and subcooled and is then introduced at the top of the absorber. The absorber produces an overhead stream that is used as a lean reflux stream for the main fractionation tower. The third vapor stream is sent to the expander for pressure reduction and work extraction. An alternate embodiment proposed by Lee involves using a portion of a high-pressure residue gas stream as a top feed stream to the absorber. In this case, vapor exiting the cold separator is split two ways, with one stream being cooled and sent to the bottom of the absorber, while the other stream is sent to the expander. A part of the lean residue gas is condensed under pressure and sent as a top feed stream to the absorber column.

A need exists for an ethane recovery process that is capable of achieving a recovery efficiency of at least 96%, but with lower energy consumption compared to prior art processes, which would be less expensive to operate than many prior art processes. A need also exists for a process that can take advantage of temperature profiles within a process to reduce the amount of C2+ components that are lost in the residue gas streams.

SUMMARY OF THE INVENTION

In view of the foregoing, the present invention advantageously provides a process and apparatus for the recovery of ethane and heavier components from a hydrocarbon stream utilizing an enhanced reflux stream. Use of the enhanced reflux stream provides for an ethane recovery in excess of about 96% and a propane recovery in excess of about 99.5% since the enhanced reflux stream is substantially free of the desired products, such as C2+ components.

In the process in accordance with an embodiment of the present invention, a hydrocarbon feed stream is cooled in an inlet gas exchanger and optionally a side reboiler exchanger to partially condense the hydrocarbon feed stream forming a cooled feed stream. Cooled feed stream is sent to a separator for phase separation, thereby producing a first vapor stream and a first liquid stream. First vapor stream is preferably split into a first gas stream and a second gas stream. First gas stream contains a larger portion of the first vapor stream, which is sent to an expander where its pressure is reduced. Due to this isentropic process, temperature of the expander exhaust stream, or substantially cooled expanded stream, is substantially reduced. Substantially cooled expanded stream is sent to a fractionation tower, or distillation tower, as a lower tower feed stream. Fractionation tower can be a demethanizer tower. Fractionation tower is preferably a reboiled tower that produces on-specification ethane and heavier product at the bottom and volatile C2+ component stream at the top. Fractionation tower is preferably equipped with side reboilers to improve process efficiency.

The smaller vapor stream from the separator, or second gas stream, is sent as a bottoms absorber feed stream to an absorber column. First liquid stream is subcooled in a reflux heat exchanger and is sent to an absorber tower as an upper absorber feed stream. Absorber tower preferably contains at least one packed bed, or other mass transfer stage or zone, within the absorber tower. Mass transfer stages or zones can include any type of device that is capable of transferring molecules from a liquid flowing down the vessel containing the mass transfer zone to a gas rising through the vessel and from the gas rising through the vessel to the liquid flowing down the vessel. Various tray types, packing, a separation stage or zone, and other equivalent stages or zones are encompassed. Other types of mass transfer stages or zones will be known to those skilled in the art and are to be considered within the scope of the present invention.

The subcooled liquid from the first liquid stream acts as cool lean oil that absorbs C2+ components from the vapor rising up the absorber tower. Some rectification takes place in absorber tower, which produces an absorber overhead stream and an absorber bottoms stream. Absorber overhead stream is substantially leaner in C2+ components than first vapor stream. Absorber overhead stream is condensed and then sent to fractionation tower as first tower feed stream, preferably at a top tower feed location. Absorber bottoms stream is subcooled and sent as a second tower feed stream to fractionation tower. Second tower feed stream is preferably sent to fractionation tower at a feed location located below that of first tower feed stream. Absorber bottoms stream acts as cooled lean oil stream and increases C2+ and heavier component recovery in the fractionation tower.

First and second tower feed streams, along with lower feed streams discussed herein, are separated in fractionation tower to produce tower overhead stream and tower bottoms stream. Tower overhead stream is preferably warmed in several exchangers and then compressed in compressors to the required pressure to produce residue gas stream.

As another embodiment, the present invention advantageously provides an ethane recovery process that utilizes an additional tower feed stream that is fed to the fractionation tower at a feed location located above the top tower feed stream from the last described embodiment. This embodiment is capable of providing 99+% C2+ recovery. The additional feed stream is produced by taking a side stream of the residue gas stream and condensing and subcooling the side stream prior to sending this stream to the fractionation tower as a top feed stream. Preferably, the residue gas side stream is essentially free of C2+ components, which enables the additional feed stream to recover any C2+ components that could escape in the tower overhead stream.

Yet another embodiment for the present invention is advantageously provided. In this embodiment, a portion of the inlet feed gas stream is sent to the absorber tower as a bottoms feed stream prior to the inlet feed gas stream being cooled.

In addition to the method embodiments, apparatus embodiments of the present invention are also advantageously provided.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF THE DRAWINGS

For simplification of the drawings, figure numbers are the same in the figures for various streams and equipment when the functions are the same, with respect to the streams or equipment, in each of the figures. Like numbers refer to like elements throughout, and 100 series and 200 series notation, where used, generally indicate similar elements in alternative embodiments.

As used herein, the term "inlet gas" means a hydrocarbon gas, such gas is typically received from a high-pressure gas line and is substantially comprised of methane, with the balance being C2 components, C3 components and heavier components as well as carbon dioxide, nitrogen and other trace gases. The term "C2 components" means all organic components having at least two carbon atoms, including aliphatic species such as alkanes, olefins, and alkynes, particularly, ethane, ethylene, acetylene, and the like. The term "C2+ components" means all $C_2$ components and heavier components.

Table I illustrates the composition of a hydrocarbon gas feed stream in which the present invention would be well suited to recover hydrocarbons in accordance with all embodiments of the present invention.

TABLE I

| Component | Mol % |
|---|---|
| Nitrogen | 7.2540 |
| CO2 | 0.0201 |
| Methane | 79.6485 |
| Ethane | 8.1518 |
| Propane | 3.1349 |
| n-Butane | 0.4746 |
| i-Butane | 0.8673 |
| n-Pentane | 0.2039 |
| i-Pentane | 0.1666 |
| Hexane | 0.0698 |
| Heptane+ | 0.0086 |

Detailed Description of Prior Art

Figure 1:
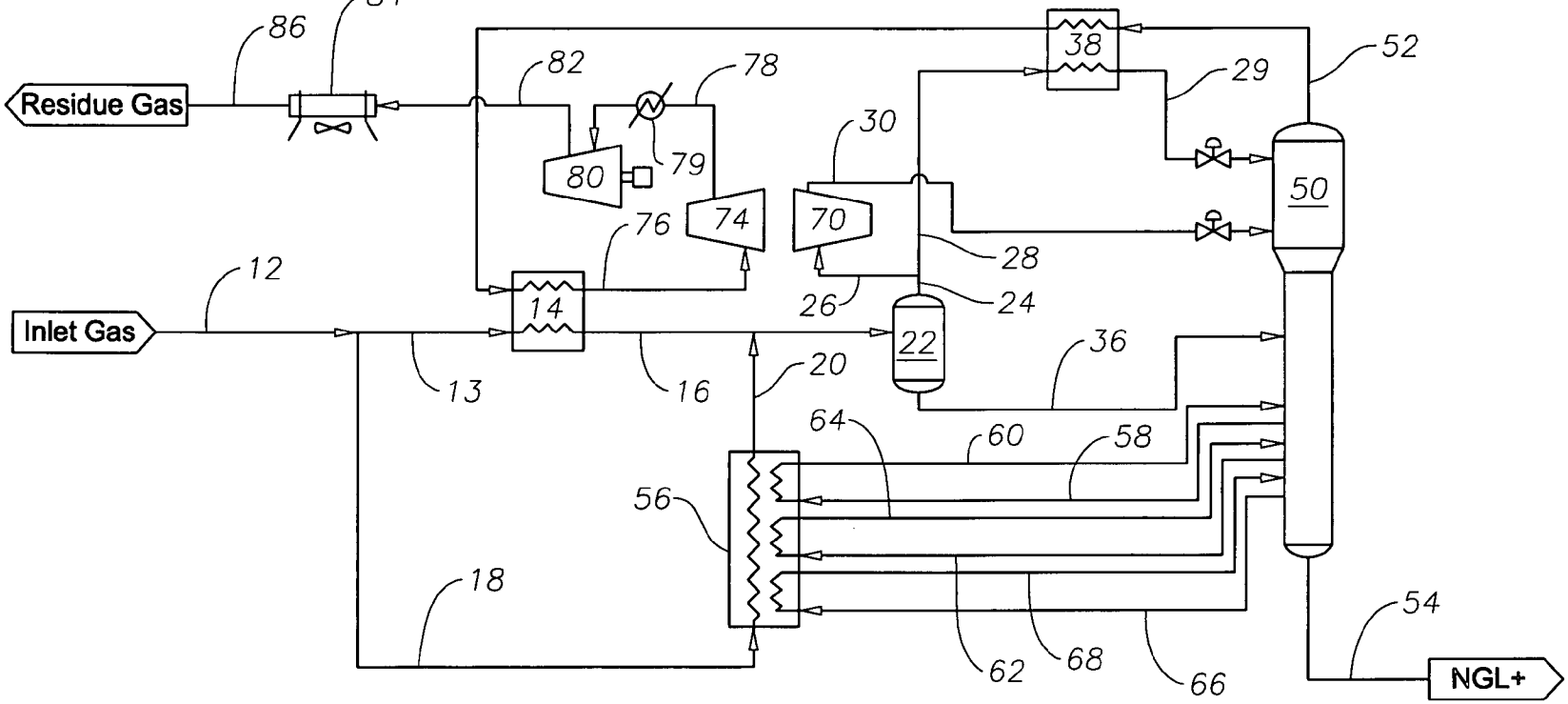
Fig. 1 (Prior Art)
FIG. 1 is a simplified flow diagram of a typical ethane and heavier component recovery process, in accordance with a prior art process as taught by U.S. Pat. No. 4,278,457.

FIG. 1 illustrates a typical gas processing scheme using turboexpander cryogenic processing, which is an embodiment of the processes described in U.S. Pat. No. 4,278,457 issued to Campbell et al. In this prior art embodiment, a raw feed inlet gas stream can contain certain materials that are detrimental to cryogenic processing. These impurities include water, CO2, H2S etc. It is assumed that raw feed gas is treated to remove CO2 and H2S if they are present in large quantities. The gas is then dried and filtered before being sent to the cryogenic section for NGL recovery. Clean and dry hydrocarbon feed gas stream 12, which is typically supplied at approximately 130° F. and 1035 psia, is typically split into a first feed stream 13 and a second feed stream 18, with first feed stream 13 containing approximately 61% of feed stream 12 and second feed stream containing the remaining portion of feed stream 12. First feed stream 13 is cooled against cold process streams in one or more inlet exchangers 14 to approximately −29° F., while second feed stream 18 is cooled against process streams from a fractionation tower 50 in reboiler/side reboiler 56 to approximately −26° F. Depending on the richness of the feed gas stream 12 and feed temperature and pressure, external refrigeration for additional cooling may be needed.

First and second feed streams are combined to form a cooled feed gas stream 16 with a temperature of approximately −28° F. Cooled feed stream 16 is normally partially condensed and is sent to an inlet separator 22 for vapor-liquid or phase separation. Depending on the feed gas stream composition, one or more cooling steps may be required with vapor liquid separation in between the cooling steps. Cooled feed gas stream 16 is separated into a first liquid stream 36 and a first vapor stream 24. First liquid stream 36 is richer in C2+ components, such as ethane, ethylene, propane, propylene and heavier hydrocarbon components, than inlet feed gas stream 12. First liquid stream 36 is sent to a fractionation tower 50 for recovery of the valuable C2+ components. Prior to being sent to fractionation tower 50, first liquid stream 36 can be cooled to approximately −141° F. and expanded across a control valve to essentially a fractionation tower pressure. Due to this expansion of liquid, some liquid is vaporized, thereby the temperature descends, cooling the entire stream 36 and producing a two-phase stream that is sent to the fractionation tower 50.

First vapor stream 24 is split into two streams into a first gas stream 26, which contains approximately 76% of first vapor stream 24, and a second gas stream 28, which contains the remained of first vapor stream 24. First gas stream 26 is sent through a work expansion machine 70, such as a turboexpander, where the pressure of first gas stream 26 is reduced to approximately 332 psia. Due to isentropic expansion of first gas stream 26, the pressure and temperature of first gas stream 26 is reduced. Due to this reduction in pressure and extraction of work, the temperature of first gas stream 26 drops to approximately −110° F., which leads to liquid formation. This two-phase stream 30 is sent to the fractionation tower as a middle feed stream. Work generated by the turboexpander 70 is used to boost up a lean tower overhead stream 52 to produce a residue gas stream 86. Second gas stream 28 is cooled substantially so that a major portion, if not all, of second gas stream 28 is condensed. This cooled stream 29 is expanded to essentially fractionation tower pressure. Due to the reduction in pressure, some vapor is generated that will cool the entire stream 29 further. Cooled two-phase stream 29 is then sent to the fractionation tower 50 as reflux. Vapor from this reflux stream 29 combines with the vapor rising up the fractionation tower 50 to form tower overhead stream 52.

Second gas stream 28 is sent to a reflux exchanger 38, where second gas stream 28 is condensed and subcooled to approximately −149° F. to produce a first tower feed stream 29. First tower feed stream 29 is then flashed across an expansion device, such as a control valve, to essentially fractionation tower pressure. Reduction in pressure of first tower feed stream 29 leads to vapor formation and a reduction of temperature to approximately −162° F. This two-phase stream 29 is sent to fractionation tower 50 as a top feed stream.

Fractionation tower 50 preferably is a reboiled absorber that produces a tower bottoms stream 54, which contains a larger part of the C2+ components or NGL in the inlet feed gas stream 12, and a tower overhead stream 52, which contains the remaining ethane, methane and lighter components. Fractionation tower 50 preferably includes a reboiler 56 to control the amount of methane that leaves with the NGL in tower bottoms stream 54. To further enhance the efficiency of the process, one or more side reboilers can be provided that cool inlet feed gas stream 12 and aid in the condensation of high pressure feed gas stream 12. Depending on the feed richness and delivery conditions, some external heating for fractionation tower 50 may be required.

Tower overhead stream 52, which typically has a pressure of approximately 332 psia and a temperature of approximately −146° F., is warmed in reflux exchanger 38 to approximately −56° F., and then to 119° F. in inlet exchanger 14 to produce a warmed overhead tower stream 76. Warmed overhead tower stream 76 is sent to the booster compressor 74 where its pressure is raised to approximately 401 psia using work generated by expander 70 to produce compressed overhead gas stream 78. Compressed overhead gas stream 78 is then cooled to approximately 130° F. in an air cooler 79 and sent for further compression in recompressor 80 to approximately 1070 psia to produce warm residue gas stream 82. Warm residue gas stream 82 is then cooled in air cooler 84 to approximately 130° F. and is then sent for further processing as residue gas stream 86.

A simulation was performed using the prior art process described herein and illustrated in FIG. 1. The molar composition of several process streams is provided in Table II for comparison purposes.

TABLE II for Process in FIG. 1

| | Mol % | | | |
|---|---|---|---|---|
| Component | Feed (12) | Reflux (29) | Overhead (52) | NGL (54) |
| Nitrogen | 7.2540 | 7.6817 | 8.2782 | |
| CO2 | 0.0201 | 0.0196 | 0.0120 | 0.0773 |
| Methane | 79.6485 | 81.9167 | 90.7259 | 1.1864 |
| Ethane | 8.1518 | 7.3687 | 0.9305 | 59.3006 |
| Propane | 3.1349 | 2.2379 | 0.0491 | 24.9915 |
| n-Butane | 0.4746 | 0.2569 | 0.0020 | 3.8217 |
| i-Butane | 0.8673 | 0.4039 | 0.0022 | 6.9955 |
| n-Pentane | 0.2039 | 0.0626 | 0.0001 | 1.6468 |
| i-Pentane | 0.1666 | 0.0426 | 0.0001 | 1.3465 |
| Hexane | 0.0698 | 0.0088 | 0.0000 | 0.5638 |
| Heptane+ | 0.0086 | 0.0005 | 0.0000 | 0.0699 |
| Mol/hr | 411518 | 90000 | 360607 | 50911 |
| Temperature (° F.) | 130.0 | −28.0 | 130.0 | 100.0 |
| Pressure (psia) | 1035 | 1030 | 1065 | 545 |
| C2 Recovery (%) | 90 | | | |
| C3 Recovery (%) | 98.63 | | | |
| Residue Compression (hp) | 223419 | | | |

Description of the Present Invention

Figure 2:
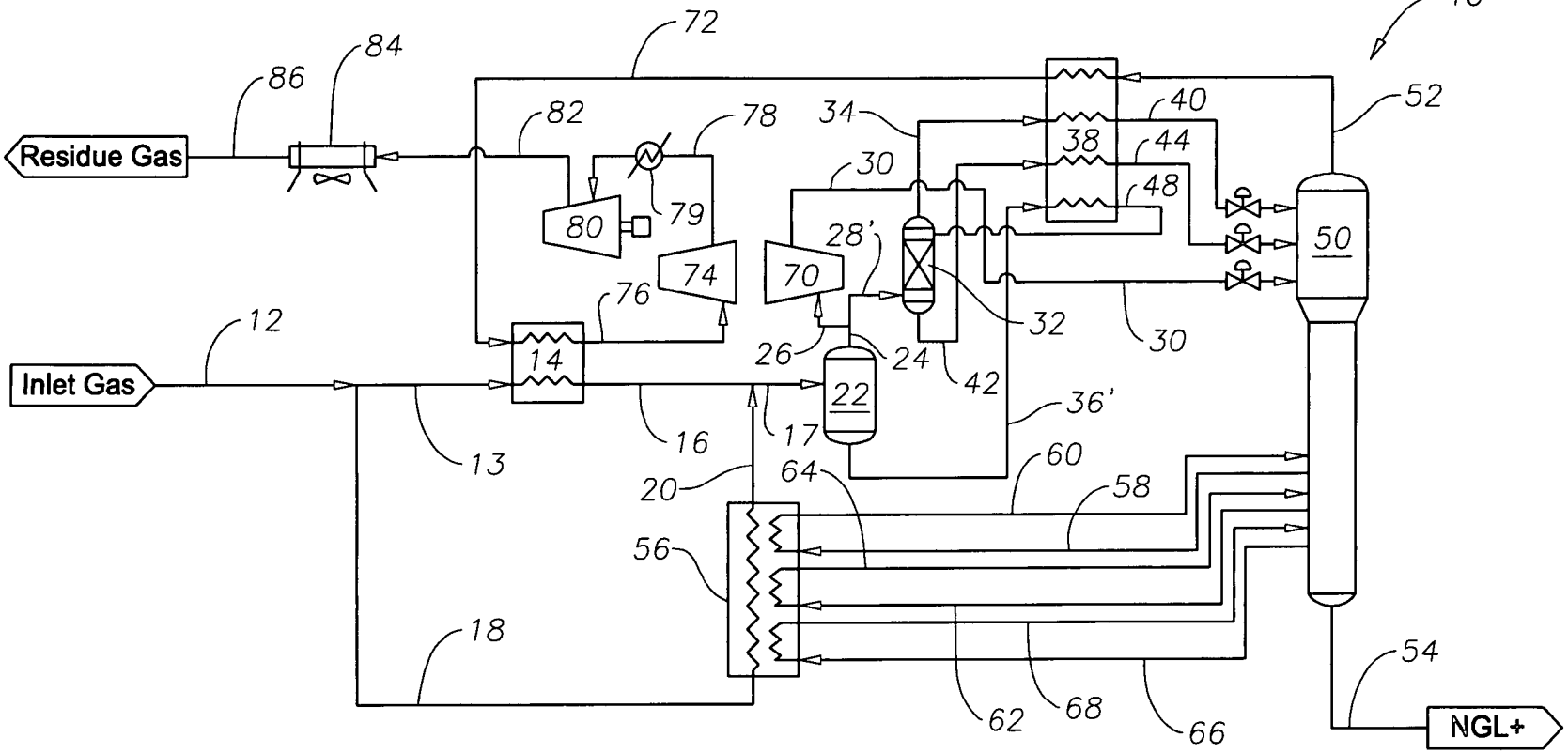
FIG. 2 is a simplified flow diagram of a ethane and heavier components recovery process that utilizes an enhanced reflux stream to decrease the amount of C2+ components in the tower overhead stream according to an embodiment of the present invention.

The present invention advantageously provides a process for separating an inlet feed gas stream containing methane and lighter components, C2 components, C3 components and heavier hydrocarbons into a more volatile gas fraction containing substantially all of the methane and lighter components and a less volatile hydrocarbon fraction containing a major portion of C2 components, C3 components and heavier hydrocarbons, as shown in FIG. 2.

More specifically, a feed gas stream 12 is supplied that has been filtered and dried prior to being sent to this ethane recovery process 10. Feed gas stream 12 can contain certain impurities, such as water, carbon monoxide, and hydrogen sulfide, which need to be removed prior to being sent to ethane recovery process 10. Feed gas stream 12 preferably has a temperature of approximately 130° F. and a pressure of approximately 1035 psia. Once supplied to process 10, feed gas stream 12 can be split into a first feed stream 13, which contains approximately 62% of feed gas stream 12, and a second feed stream 18, which contains the remaining portion of feed gas stream 12. First feed stream 13 is advantageously cooled and partially condensed in inlet exchanger 14 by heat exchange contact with at least a tower overhead stream 52 to a temperature of approximately −29° F. to produce a cooled first feed stream 16. Second feed stream 18 is preferably cooled in a reboiler 56 by heat exchange contact with at least a first tower side-draw stream 58, a second tower side-draw stream 62, a third tower side-draw stream 66, and combinations thereof to a temperature of approximately −43° F. to produce cooled second feed stream 20. Second cooled feed stream 20 is combined with cooled first feed stream 16 to form a combined feed stream 17 having a temperature of approximately −34° F.

Combined feed stream 17 is separated into a first vapor stream 24 and a first liquid stream 36' in separator 22. First vapor stream 24 is split into a first gas stream 26, which contains approximately 75% of first vapor stream 24, and a second gas stream 28', which contains the remainder of first vapor stream 24. First gas stream 26 is sent to an expander 70 and expanded to a lower pressure of approximately 312 psia to produce a lower tower feed stream 30. Due to the reduction in pressure in first gas stream 26 and extraction of work, the temperature of first gas stream 26 is also reduce to approximately −119° F. The decrease in temperature causes liquid formation, which causes tower feed stream 30 to be two-phased. Tower feed stream 30 is sent to a fractionation tower 50 preferably as a lower tower feed stream.

Lower tower feed stream 30, along with a first tower feed stream 40 and a second tower feed stream 44, are sent to fractionation tower 50 where the streams are separated into a tower bottoms stream 54 and a tower overhead stream 52. Tower overhead stream 52 is warmed and compressed to produce a residue gas stream 76.

As an improvement of the present invention, second gas stream 28' is sent to an absorber tower 32 as a lower absorber feed stream. Absorber tower 32 preferably contains one or more mass transfer stages or zones. First liquid stream 36' is then cooled and supplied to absorber tower 32 as a top absorber feed stream 48. Warm vapor rising to the top of absorber tower 32 intimately contacts the cold, heavier liquids flowing down absorber tower 32. The cold, heavier liquids absorb the heavier components from the warm vapor. Absorber tower 32 preferably produces an absorber overhead stream 34 and an absorber bottoms stream 42.

Absorber overhead stream 34 preferably has a temperature of approximately −72° F. and is much leaner than reflux stream 29 in FIG. 1 in the prior art process. Absorber overhead stream 34 is then cooled to approximately −155° F. and thereby substantially condensed in reflux exchanger 38 by heat exchange contact with at least one of the following streams: absorber bottoms stream 42, tower overhead stream 52, first liquid stream 36', and combinations thereof. Such condensation produces first tower feed stream 40, which is considered to be an enhanced reflux stream to fractionation tower 50. Similarly, absorber bottoms stream 42 can be cooled in reflux exchanger 38 by heat exchange contact with at least one of the following streams: absorber overhead stream 34, tower overhead stream 52, first liquid stream 36', and combinations thereof. Cooling absorber bottoms stream 42 produces the second tower feed stream 44 to a temperature of approximately −155° F. to produce second tower feed stream 44.

The quantities and temperatures of the first and second tower feed streams 40, 44 are maintained so that a tower overhead temperature of the tower overhead stream 52 is maintained and a major portion of the C2 components, C3 components and heavier hydrocarbons is recovered in the tower bottoms stream 54.

As in the prior art process described herein, fractionation tower 50, or demethanizer, preferably is a reboiled absorber that produces a tower bottoms stream 54, which contains a larger part of the C2+ components or NGL in the inlet feed gas stream 12, and a tower overhead stream 52, which contains the remaining ethane, methane and lighter components. Fractionation tower 50 preferably includes a reboiler 56 to control the amount of methane that leaves with the NGL in tower bottoms stream 54. To further enhance the efficiency of the process, one or more side reboilers can be provided that cool inlet feed gas stream 12 and aid in the condensation of high pressure feed gas stream 12, along with increase the efficiency of the process. Depending on the feed richness and delivery conditions, some external heating for fractionation tower 50 may be required.

The process steps of warming tower overhead stream 52, cooling first liquid stream 36', cooling and thereby substantially condensing absorber overhead stream 34, and cooling absorber bottoms stream 42 can be performed by heat exchange contact with a process stream selected from the group consisting of tower overhead stream 52, first liquid stream 36', absorber overhead stream 34, absorber bottoms stream 42, and combinations thereof. Other suitable streams, as understood by those of ordinary skill in the art, can be used to warm and/or cool the respective streams described herein and are to be considered within the scope of the present invention.

In all embodiments of the present invention, a plurality of side-draw streams are removed from a lower portion of fractionation tower 50, heated in reboiler 56 by heat exchange contact with second feed stream 18, and are returned to essentially at the same stage of fractionation tower 50 than that from which they were removed.

Tower overhead stream 52, which typically has a pressure of approximately 302 psia and a temperature of approximately −160° F., is warmed in reflux exchanger 38 to approximately −59° F., and then to 122° F. in inlet exchanger 14 to produce a warmed overhead tower stream 76. Warmed overhead tower stream 76 is sent to the booster compressor 74 where its pressure is raised to approximately 374 psia using work generated by expander 70 to produce compressed overhead gas stream 78. Compressed overhead gas stream 78 is then cooled to approximately 130° F. in an air cooler 79 and sent for further compression in recompressor 80 to approximately 1070 psia to produce warm residue gas stream 82. Warm residue gas stream 82 is then cooled in air cooler 84 to approximately 130° F. and is then sent for further processing as residue gas stream 86.

As described herein, the prior art process shown in FIG. 1 has limitations on the maximum ethane recovery due to equilibrium conditions at the top of fractionation tower 150. To overcome this limitation, the present invention reduces the amount of C2+ components in the reflux stream back to fractionation tower 150, which enables higher recoveries since less C2+ components are in the tower overhead stream 152.

A simulation was performed using the process according to a first embodiment of the present invention. The molar composition of several process streams are provided in Table III for comparison purposes to the results related to the prior art process in Table II.

TABLE III for Process in FIG. 2

| Component | Mol % Feed (12) | Reflux (40) | Overhead (52) | NGL (54) |
|---|---|---|---|---|
| Nitrogen | 7.2540 | 8.7093 | 8.3308 | |
| CO2 | 0.0201 | 0.0156 | 0.0122 | 0.0730 |
| Methane | 79.6485 | 84.9471 | 91.2910 | 1.2137 |
| Ethane | 8.1518 | 4.5407 | 0.3542 | 60.6831 |
| Propane | 3.1349 | 1.2950 | 0.0111 | 24.1790 |
| n-Butane | 0.4746 | 0.1565 | 0.0003 | 3.6696 |
| i-Butane | 0.8673 | 0.2540 | 0.0003 | 6.7086 |
| n-Pentane | 0.2039 | 0.0433 | 0.0000 | 1.5771 |
| i-Pentane | 0.1666 | 0.0306 | 0.0000 | 1.2892 |
| Hexane | 0.0698 | 0.0074 | 0.0000 | 0.5397 |
| Heptane+ | 0.0086 | 0.0005 | 0.0000 | 0.0669 |
| Mol/hr | 411518 | 77540 | 358329 | 53189 |
| Temperature (° F.) | 130.0 | −72.0 | 130.0 | 100.0 |
| Pressure (psia) | 1035 | 1030 | 1065 | 545 |
| C2 Recovery (%) | 96.2 | | | |
| C3 Recovery (%) | 99.7 | | | |
| Residue Compression (hp) | 241112 | | | |

By comparing Tables II and III, it is evident that the new process illustrated in FIG. 2 generates a much leaner reflux stream, thereby leading to higher recoveries of C2+ components. Particularly, C3+ recovery is improved substantially in Table III versus Table II. The increase in recovery of C3+ is due to the lower amount of C3+ in the reflux stream 40 being sent to the top of fractionation tower 50 than in the prior art process shown in FIG. 1.

Table IV illustrates an economic comparison between the process schemes shown in FIGS. 1 and 2. Based on current assumed prices of products and natural gas, the process scheme in FIG. 2 in accordance with an embodiment of the present invention recovers higher amounts of desired components. After accounting for fuel gas shrinkage, and additional fuel consumption, the pay out for this new process is estimated to be less than six months.

TABLE IV

| | FIG. 1 | FIG. 2 | Δ (Delta) | Price $/GAL $/ MMBTU | $/Day |
|---|---|---|---|---|---|
| C2 (BPD) | 174766.0 | 186842.6 | 12077 | 0.25 | 126,805 |
| C3(BPD) | 128838.6 | 129751.3 | 913 | 0.5 | 19,167 |
| Residue (MMSCFD) | 3284.2 | 3263.5 | −20.7 | 3 | −52,412 |
| Compression (hp) | 223415 | 241112 | −17697 | 3 | −10,193 |
| Increase in Revenue | | | | | 83,366 |
| Turbine Cost (MM$) | | | | | 8.8 |
| Add Margin (MM$/yr) | | | | | 30.4 |
| Payout (yr) | | | | | 0.29 |

Turbine Cost: $500/hp
Turbine heat rate 8000 BTU/hp-hr

The process embodiments of the present invention can also include expanding the second gas stream 58 and at least a portion of the substantially cooled first liquid stream 36 to an intermediate pressure between the feed gas pressure and the lower pressure. Absorber tower 32 can be operated at the intermediate pressure.

The process embodiments of the present invention can also include cooling and expanding the second gas stream 58 to an intermediate pressure between the feed gas pressure and the lower pressure. At least a portion of the substantially cooled first liquid stream 36 can be substantially cooled and expanded at the intermediate pressure. Absorber tower 32 can be operated at the intermediate pressure.

Figure 3:
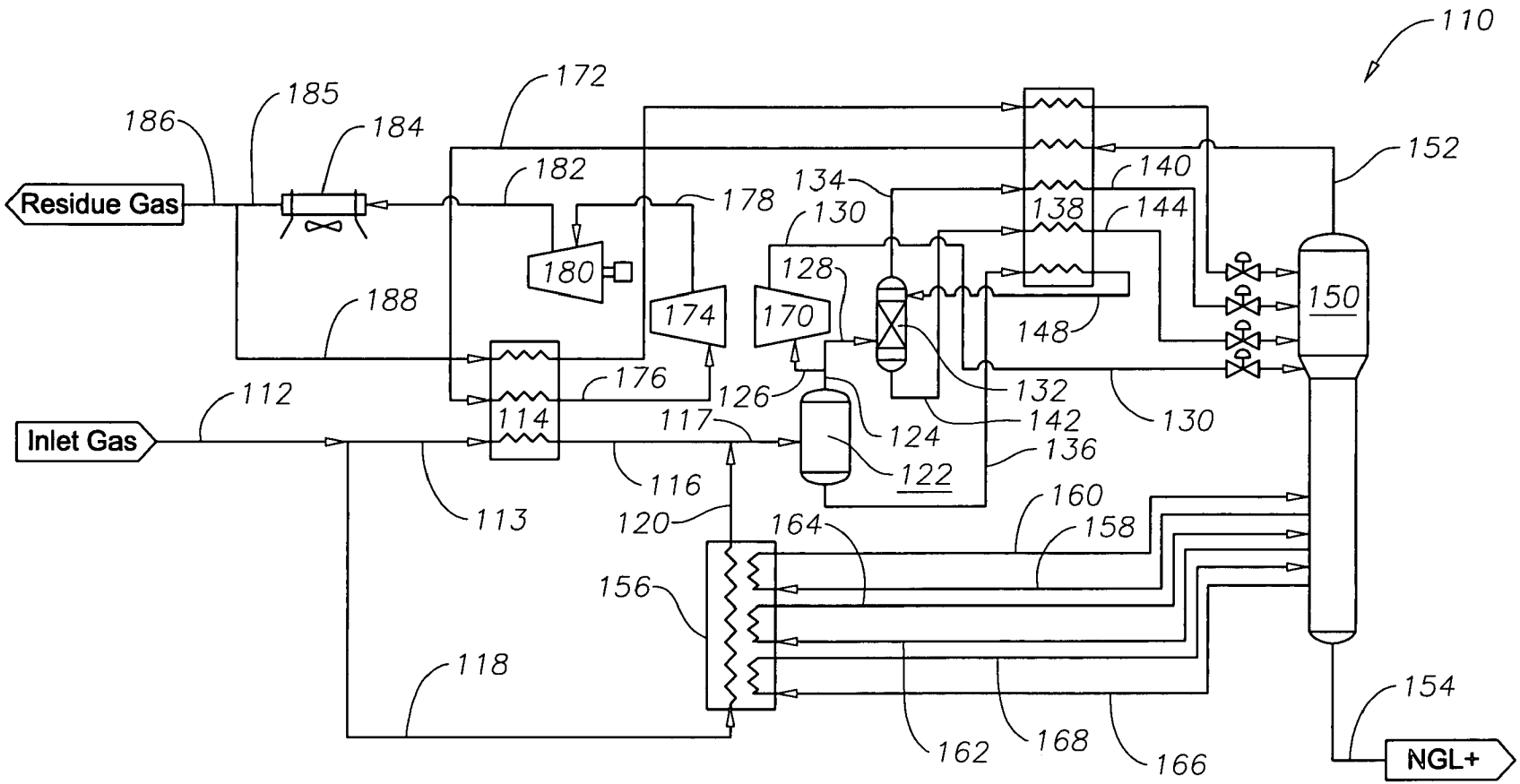
FIG. 3 is a simplified flow diagram of a ethane and heavier compound recovery process that utilizes a residue recycle stream, along with an enhanced reflux stream, to decrease the amount of C2+ components in the tower overhead stream according to an embodiment of the present invention.

As another embodiment of the present invention, a process for separating an inlet feed gas stream 112 containing methane and lighter components, C2 components, C3 components and heavier hydrocarbon components into a more volatile fraction containing the methane and lighter components and a less volatile fraction containing a major portion of C2 components, C3 components and heavier hydrocarbons 110 is advantageously provided, as shown in FIG. 3. This embodiment can be used when higher ethane recoveries, i.e. 98% to 99%, are required.

In this embodiment, a feed gas stream 112 is supplied that has been filtered and dried prior to being sent to this ethane recovery process 110. Feed gas stream 112 can contain certain impurities, such as water, carbon monoxide, and hydrogen sulfide, which need to be removed prior to being sent to ethane recovery process 110. Feed gas stream 112 preferably has a temperature of approximately 130° F. and a pressure of approximately 1035 psia. Once supplied to process 110, feed gas stream 112 can be split into a first feed stream 113, which contains approximately 60% of feed gas stream 112, and a second feed stream 118, which contains the remaining portion of feed gas stream 112. First feed stream 113 is advantageously cooled and partially condensed in inlet exchanger 114 by heat exchange contact with at least a tower overhead stream 152, a residue recycle stream 188, and combinations thereof to a temperature of approximately −25° F. to produce a cooled first feed stream 116. Second feed stream 118 is preferably cooled in a reboiler 156 by heat exchange contact with at least a first tower side-draw stream 158, a second tower side-draw stream 162, a third tower side-draw stream 166, and combinations thereof to a temperature of approximately −37° F. to produce cooled second feed stream 120. Second cooled feed stream 120 is combined with cooled first feed stream 116 to form a combined feed stream 117 having a temperature of approximately −30° F.

Combined feed stream 117 is separated into a first vapor stream 124 and a first liquid stream 136 in separator 122. First vapor stream 124 is split into a first gas stream 126, which contains approximately 76% of first vapor stream 124, and a second gas stream 128, which contains the remainder of first vapor stream 124. First gas stream 126 is sent to an expander 170 expanded to a lower pressure of approximately 326 psia to produce a lower tower feed stream 130. Due to the reduction in pressure in first gas stream 126 and extraction of work, the temperature of first gas stream 126 is also reduce to approximately −112° F. The decrease in temperature causes liquid formation, which causes tower feed stream 130 to be two-phased. Tower feed stream 130 is sent to a fractionation tower 150 preferably as a lower tower feed stream.

Lower tower feed stream 130, along with a first tower feed stream 140 and a second tower feed stream 144, are sent to fractionation tower 150 where the streams are separated into a tower bottoms stream 154 and a tower overhead stream 152. Tower overhead stream 152 is warmed and compressed to produce a residue gas stream 186.

As an improvement of the present invention, second gas stream 128 is sent to an absorber tower 132 as a lower absorber feed stream. As in the other embodiments of the present invention, absorber tower 132 preferably contains one or more mass transfer stages. First liquid stream 136 is then cooled and supplied to absorber tower 132 as a top absorber feed stream 148. Warm vapor rising to the top of absorber tower 132 intimately contacts the cold, heavier liquids flowing down absorber tower 132. The cold, heavier liquids absorb the heavier components from the warm vapor. Absorber tower 132 preferably produces an absorber overhead stream 134 and an absorber bottoms stream 142.

Absorber overhead stream 134 preferably has a temperature of approximately −62° F. and is much leaner than reflux stream 29 in FIG. 1 in the prior art process, but not as lean as reflux stream 40 in FIG. 2. Absorber overhead stream 134 is then cooled to approximately −155° F. and thereby substantially condensed in reflux exchanger 138 by heat exchange contact with at least one of the following streams: absorber bottoms stream 142, tower overhead stream 152, first liquid stream 136, residue recycle stream 188, and combinations thereof. The heat exchange contact between the streams produces first tower feed stream 140. Similarly, at least a portion of absorber bottoms stream 142 can be cooled in reflux exchanger 138 by heat exchange contact with at least one of the following streams: absorber overhead stream 134, tower overhead stream 152, first liquid stream 136, residue recycle stream 188, and combinations thereof. Cooling absorber bottoms stream 142 produces the second tower feed stream 144 having a temperature of approximately −155° F. to produce second tower feed stream 144.

Tower overhead stream 152, which typically has a pressure of approximately 316 psia and a temperature of approximately −161° F., is warmed in reflux exchanger 138 to approximately −50° F., and then to 121° F. in inlet exchanger 14 to produce a warmed overhead tower stream 176. Warmed overhead tower stream 176 is sent to the booster compressor 174 where its pressure is raised to approximately 387 psia using work generated by expander 170 to produce compressed overhead gas stream 178. Compressed overhead gas stream 178 is then cooled to approximately 130° F. in an air cooler 179 and sent for further compression in recompressor 180 to approximately 1070 psia to produce warm residue gas stream 182. Warm residue gas stream 182 is then cooled in air cooler 184 to approximately 130° F. and is then sent for further processing as residue gas stream 186.

A portion of residue gas stream 186 is removed to produce a residue recycle stream 188. Residue recycle stream 188 is cooled to approximately −25° F. and thereby substantially condensed prior to returning residue recycle stream 188 to fractionation tower 150 at a top feed location. Because residue recycle stream 188 essentially does not contain any C2+ components, residue recycle stream 188 is a good source of top reflux for fractionation tower 150. Quantities and temperatures of the first and second tower feed streams 140, 144 are maintained so that a tower overhead temperature of the tower overhead stream 152 is maintained and a major portion of the C2 components, C3 components and heavier hydrocarbons is recovered in the tower bottoms stream 154.

A simulation was performed using the prior art process described herein. The molar composition of several process streams is provided in Table V for comparison purposes. As can be seen, this embodiment results in high recovery of C2+ components.

TABLE V for Process in FIG. 3

| | Mol % | | | |
|---|---|---|---|---|
| Component | Feed (112) | Reflux (188) | Overhead (152) | NGL (154) |
| Nitrogen | 7.2540 | 8.3244 | 8.3460 | |
| CO2 | 0.0201 | 0.0178 | 0.0118 | 0.0746 |
| Methane | 79.6485 | 84.5468 | 91.4544 | 1.2204 |
| Ethane | 8.1518 | 5.2609 | 0.1877 | 61.0584 |
| Propane | 3.1349 | 1.3659 | 0.0001 | 23.9594 |
| n-Butane | 0.4746 | 0.1579 | 0.0000 | 3.6271 |
| i-Butane | 0.8673 | 0.2510 | 0.0000 | 6.6291 |
| n-Pentane | 0.2039 | 0.0406 | 0.0000 | 1.5581 |
| i-Pentane | 0.1666 | 0.0280 | 0.0000 | 1.2736 |
| Hexane | 0.0698 | 0.0062 | 0.0000 | 0.5331 |
| Heptane+ | 0.0086 | 0.0004 | 0.0000 | 0.0661 |
| Mol/hr | 411518 | 81363 | 357676 | 53842 |
| Temperature (° F.) | 130.0 | −61.6 | 130.0 | 100.0 |
| Pressure (psia) | 1035 | 1025 | 1065 | 545 |
| C2 Recovery (%) | 98 | | | |
| C3 Recovery (%) | 100 | | | |
| Residue Compression (hp) | 247364 | | | |

Figure 4:
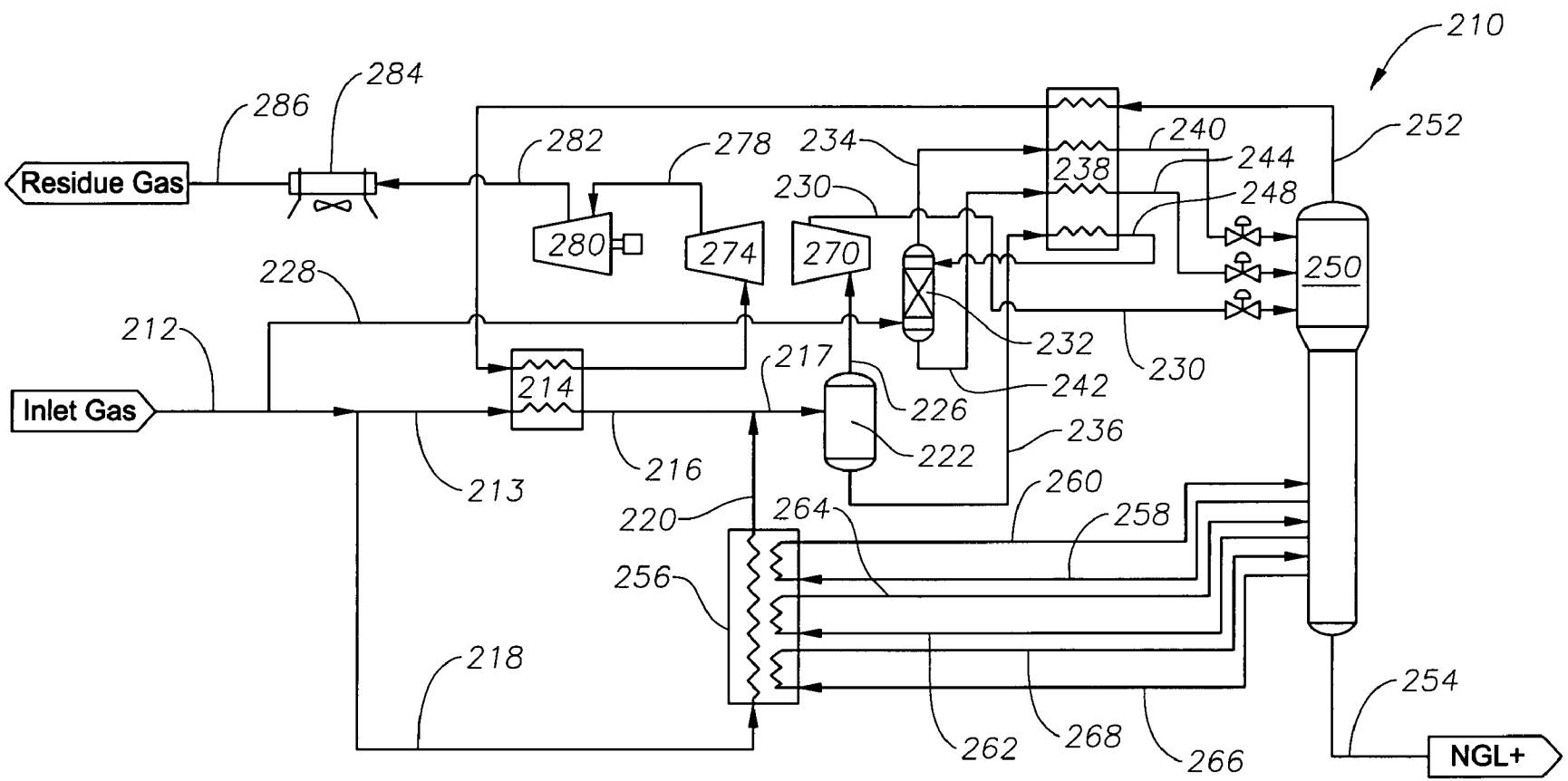
FIG. 4 is a simplified diagram of an ethane and heavier compound recovery process that utilizes a portion of the feed gas stream as a lower absorber feed stream to produce the enhanced reflux stream for the fractionation tower according to an embodiment of the present invention.

As another embodiment of the present invention, a process for separating a feed gas stream containing methane and lighter components, C2 components, C3 components and heavier hydrocarbon components into a more volatile fraction containing the methane and lighter components and a less volatile fraction containing a major portion of C2 components, C3 components and heavier hydrocarbons 210 is advantageously provided, as shown in FIG. 4. In this embodiment of this process 210, a feed gas stream 212 is split into a first feed gas stream 213, a second feed gas stream 218, and a third feed gas stream 228.

First feed gas stream 213 cooled and partially condensed to produce a cooled feed stream 216, which is then separated into a first vapor stream 226 and a first liquid stream 236. First vapor stream 226 is expanded to a low pressure to produce a lower tower feed stream 230.

First feed stream 213 is advantageously cooled and partially condensed in inlet exchanger 214 by heat exchange contact with at least a tower overhead stream 252 to a temperature of approximately −25° F. to produce a cooled first feed stream 216. Second feed stream 218 is preferably cooled in a reboiler 256 by heat exchange contact with at least a first tower side-draw stream 258, a second tower side-draw stream 262, a third tower side-draw stream 266, and combinations thereof to a temperature of approximately −37° F. to produce cooled second feed stream 220. Second cooled feed stream 220 is combined with cooled first feed stream 216 to form a combined feed stream 217 having a temperature of approximately −30° F.

Combined feed stream 217 is separated into a first gas stream 226 and a first liquid stream 236 in separator 222. First gas stream 226 is sent to an expander 270 expanded to a lower pressure of approximately 326 psia to produce a lower tower feed stream 230. Due to the reduction in pressure in first gas stream 226 and extraction of work, the temperature of first gas stream 226 is also reduce to approximately −112° F. The decrease in temperature causes liquid formation, which causes tower feed stream 230 to be two-phased. Tower feed stream 230 is sent to a fractionation tower 250 preferably as a lower tower feed stream.

Lower tower feed stream 230, along with a first tower feed stream 240 and a second tower feed stream 244, are supplied to fractionation tower 250 where the streams are then separated into a tower bottoms stream 254 and a tower overhead stream 252. Tower overhead stream 252 is then warmed and subsequently compressed to produce a residue gas stream 286.

As an improvement of this process embodiment, third feed gas stream 228 is supplied to an absorber tower 232 containing one or more mass transfer stages as a lower absorber feed stream. First liquid stream 236 is cooled and then also supplied to absorber tower 232 as a top absorber feed stream 248. Absorber tower 232 advantageously produced an absorber overhead stream 234 and an absorber bottoms stream 242.

Absorber overhead stream 234 is cooled so that at least a portion of the absorber overhead stream 234 is substantially condensed to produce the first tower feed stream 240. Absorber bottoms stream 242 can also be cooled so that at least a portion of the absorber bottoms stream 242 is substantially condensed to produce the second tower feed stream 244. Quantities and temperatures of first and second tower feed streams 240, 244 are maintained so that a tower overhead temperature of tower overhead stream 252 is maintained and a major portion of the C2 components, C3 components and heavier hydrocarbons is recovered in tower bottoms stream 254.

The embodiment of the present invention illustrated in FIG. 4 is not as effective as the embodiment illustrated in FIG. 2. Less liquid is available for absorption in absorber tower 232, which produces a reflux stream 240 that is not as lean in C2+ as reflux stream 40 in FIG. 2. The maximum recovery of the scheme in FIG. 4 is lower than the scheme in FIG. 2. This scheme does have lower capital costs associated with it in comparison to the scheme in FIG. 2 because a smaller inlet gas exchanger 214 can be used since less feed is being cooled in inlet exchanger 214.

In addition to the process embodiments described herein, the present invention also advantageously provides the apparatus required to perform the process embodiments. More specifically, the present invention advantageously includes a fractionation tower 50, an absorber tower 32, an inlet separator 22, an expander 70, a plurality of compressors 74, 80, a plurality of exchangers 14, 56, 38, 84, and the remaining equipment described herein and illustrated on FIGS. 2–4.

As an embodiment of the present invention, an apparatus for separating an inlet gas stream containing methane and lighter components, C2 components, C3 components and heavier hydrocarbons into a more volatile gas fraction containing substantially all of the methane and lighter components and a less volatile hydrocarbon fraction containing a major portion of C2 components, C3 components and heavier hydrocarbons is advantageously provided. In this embodiment, the apparatus includes a first cooler 14, a first separator 22, a first expander, a fractionation tower 50, a first heater 38, an absorber tower 32, a second cooler 38, a third cooler 38, and a fourth cooler 38.

First cooler, or inlet exchanger, 14 is preferably used for cooling and partially condensing a feed gas stream having a feed gas pressure to provide a cooled feed stream 12. First separator, or inlet separator, 22 is preferably used for separating the cooled feed stream 12 into a first vapor stream 24 and a first liquid stream 36'. As indicated previously, first vapor stream 24 can be split into a first gas stream 26 and a second gas stream 28'. First expander 70 can be used for expanding the first gas stream 26 to a low pressure so that the first gas stream 26 forms a lower tower feed stream 30. Fractionation tower 50 is preferably used for receiving the lower tower feed stream 30, a first tower feed stream 40, and a second tower feed stream 44 and for separating the lower tower feed stream 30, the first tower feed stream 40, and the second tower feed stream 44 into a tower bottoms stream 54 and a tower overhead stream 52. First heater 38 is used for warming tower overhead stream 52 to produce a residue gas stream 86. Absorber tower 32 preferably contains at least one or more mass transfer stages for receiving second gas stream 28' as a lower absorber feed stream 28'. Second cooler 38 is used for cooling the first liquid stream 36' and supplying absorber tower 32 with the substantially condensed first liquid stream as a top absorber feed stream 48. Absorber tower 32 preferably produces an absorber overhead stream 34 and an absorber bottoms stream 42. Third cooler 38 is preferably used for cooling and thereby substantially condensing the absorber overhead stream 34 to produce the first tower feed stream 40. Fourth cooler 38 is preferably used for cooling the absorber bottoms stream 42 to produce the second tower feed stream 44. First heater, second cooler, third cooler and fourth cooler can be a single heat exchanger or series of heat exchangers that performs the duties of each of these warmers and coolers. For example, reflux exchanger 38 shown in FIG. 1 can be used to perform each of these functions. Reflux exchanger 38 and all exchangers described herein can include a single multipath exchanger, a plurality of individual heat exchangers, or combinations thereof.

The apparatus can also include a fifth cooler (not shown) for cooling the second gas stream 28' prior to introduction into the absorber tower. The apparatus can also include a second expander (not shown) for expanding the second gas stream and at least a portion of the substantially cooled first liquid stream.

As discussed herein in all embodiments of the present invention, the expanding steps, preferably by isentropic expansion, can be effectuated with a turbo-expander, Joules-Thompson expansion valves, a liquid expander, a gas or vapor expander or the like. Also, the expanders can be linked to corresponding staged compression units to produce compression work by substantially isentropic gas expansion. The apparatus can also include a first compressor 74 for compressing the tower overhead stream 76 prior to producing the residue gas stream 86.

As an advantage of the present invention, the present invention maximizes C2+ recovery while minimizing capital and operating costs associated with building and operating a facility to perform the processes described herein. The present invention allows for greater recovery of C2+ with minimal physical changes required in a typical turboexpander process. For example, the present invention can be added to existing facilities, such as those shown in FIG. 1, without significant physical changes being made to the facility. However, the facility would realize a substantial savings in operating costs by implementing the improvements of the present invention.

While the invention has been shown or described in only some of its forms, it should be apparent to those skilled in the art that it is not so limited, but is susceptible to various changes without departing from the scope of the invention.

For example, the expanding steps, preferably by isentropic expansion, may be effectuated with a turbo-expander, Joule-Thompson expansion valves, a liquid expander, a gas or vapor expander or the like. As another example, the mass transfer stages or zones within the absorber can be any type of equipment that is capable of performing the mass transfer functions described herein. Other modifications, such as routing certain streams differently or by adjusting operating parameters to best fit feed or delivery conditions, are to be considered within the scope of the present invention.

We claim:

1. A process for separating an inlet gas stream containing methane and lighter components, C2 components, C3 components and heavier hydrocarbons into a more volatile gas fraction containing substantially all of the methane and lighter components and a less volatile hydrocarbon fraction containing a major portion of C2 components, C3 components and heavier hydrocarbons, the process comprising the steps of:

(a) cooling and partially condensing a feed gas stream having a feed gas pressure to provide a cooled feed stream;

(b) separating the cooled feed stream into a first vapor stream and a first liquid stream;

(c) splitting the first vapor stream into a first gas streamand a second gas stream;

(d) expanding the first gas stream to a low pressure so that the first gas stream forms a lower tower feed stream;

(e) supplying a fractionation tower with the lower tower feed stream, a first tower feed stream, and a second tower feed stream, the fractionation tower separating the lower tower feed stream, the first tower feed stream, and the second tower feed stream into a tower bottoms stream and a tower overhead stream;

(f) warming the tower overhead stream to produce a residue gas stream; and (g) wherein an improvement includes:

i) supplying an absorber tower containing one or more mass transfer stages with the second gas stream as a lower absorber feed stream;

ii) cooling the first liquid stream to produce a substantially condensed first liquid stream and supplying the absorber tower with the substantially condensed first liquid stream as a top absorber feed stream, the absorber tower producing an absorber overhead stream and an absorber bottoms stream;

iii) cooling and thereby substantially condensing the absorber overhead stream to produce the first tower feed stream; and iv) maintaining quantities and temperatures of the first and second tower feed streamsso that a tower overhead temperature of the tower overhead stream is maintained, and a major portion of the C2 components, C3 components and heavier hydrocarbons is recovered in the tower bottoms stream.

2. The process of claim 1, wherein the improvement further includes the step of cooling the absorber bottoms stream to produce the second tower feed stream.

3. The process of claim 1, further including the step of cooling the second gas stream prior to supplying the absorber tower with the second gas stream.

4. The process of claim 1, wherein the improvement further includes providing recovery of ethane in excess of about 96% and recovery of propane in excess of about 99.5%.

5. The process of claim 1, further including the steps of:

(a) expanding the second gas stream and at least a portion of the substantially cooled first liquid stream to an intermediate pressure between the feed gas pressure and the low pressure; and (b) operating the absorber tower at the intermediate pressure.

6. The process of claim 1, further including the step of expanding the second liquid stream to the low pressure to produce an expanded second liquid stream and directing the expanded second liquid stream to the distillation tower at a feed location below the expanded first vapor stream.

7. The process of claim 1, wherein the steps of warming the tower overhead stream, cooling the first liquid stream, cooling and thereby substantially condensing the absorber overhead stream, and cooling the absorber bottoms stream are performed by heat exchange contact with a process stream selected from the group consisting of the tower overhead stream, the first liquid stream, the absorber overhead stream, the absorber bottoms stream, and combinations thereof.

8. A process for separating an inlet feed gas stream containing methane and lighter components, C2 components, C3 components and heavier hydrocarbon components into a more volatile fraction containing the methane and lighter components and a less volatile fraction containing a major portion of C2 components, C3 components and heavier hydrocarbons, the process comprising the steps of:

(a) cooling and partially condensing an inlet feed gas stream having a feed gas pressure to provide a cooled feed stream;

(b) separating the cooled feed stream into a first vapor stream and a first liquid stream;

(c) splitting the first vapor stream into a first gas stream and a second gas stream;

(d) expanding the first gas stream to a lower pressure so that the first gas streamforms a lower tower feed stream;

(e) supplying a fractionation tower with the lower tower feed stream, a first tower feed stream, and a second tower feed stream, the fractionation tower separating the lower tower feed stream, the first tower feed stream, and the second tower feed stream into a tower bottoms stream containing a major portion of the C2 components, C3 components and heavier hydrocarbons and a tower overhead stream;

(f) warming and compressing the tower overhead stream to produce a residue gas stream;

(g) wherein an improvement comprises the steps of:

i) supplying an absorber tower containing one or more mass transfer stages with the second gas stream as a lower absorber feed stream;

ii) cooling the first liquid stream to form a substantially cooled first liquid stream and supplying the absorber tower with the first liquid stream as a top absorber feed stream, the absorber tower producing an absorber overhead stream and an absorber bottoms stream;

iii) cooling the absorber overhead streamso that at least a portion of the absorber overhead stream is substantially condensed to produce the first tower feed stream;

iv) splitting the residue gas stream into a residue recycle stream and volatile residue gas stream;

v) cooling and thereby substantially condensing the residue recycle streamprior to returning the residue recycle stream to the fractionation tower; and vi) maintaining quantities and temperatures of the first and second tower feed streams so that a tower overhead temperature of the tower overhead stream is maintained and a major portion of the C2 components, C3 components and heavier hydrocarbons is recovered in the tower bottoms stream.

9. The process of claim 8, wherein the improvement further includes the step of cooling the absorber bottoms stream so that at least a portion of the absorber bottoms stream is substantially condensed to produce the second tower feed stream.

10. The process of claim 8, further including the step of cooling the second gas stream prior to introduction into the absorber tower.

11. The process of claim 8, wherein the improvement further includes providing recovery of ethane in excess of about 96% and recovery of propane in excess of about 99.5%.

12. The process of claim 8, further including the steps of:

(a) expanding the second gas stream and at least a portion of the substantially cooled first liquid stream to an intermediate pressure between the feed gas pressure and the lower pressure; and (b) operating the absorber tower at the intermediate pressure.

13. The process of claim 8, further including the steps of:

(a) cooling and expanding the second gas stream to an intermediate pressure between the feed gas pressure and the lower pressure;

(b) substantially cooling and expanding at least a portion of the substantially cooled first liquid stream to the intermediate pressure; and (c) operating the absorber tower at the intermediate pressure.

14. The process of claim 8, further comprising the step of expanding the second tower feed stream to the lower pressure and directing the second tower feed stream to the distillation tower at a feed location below the lower tower feed stream.

15. The process of claim 8, wherein the steps of warming the tower overhead stream, cooling the first liquid stream, cooling and thereby substantially condensing at least a portion of the absorber overhead stream, and cooling the absorber bottoms stream are performed by heat exchange contact with a process stream selected from the group consisting of the tower overhead stream, the first liquid stream, the absorber overhead stream, the absorber bottoms stream, and combinations thereof.

16. A process for separating a feed gas stream containing methane and lighter components, C2 components, C3 components and heavier hydrocarbon components into a more volatile fraction containing the methane and lighter components and a less volatile fraction containing a major portion of C2 components, C3 components and heavier hydrocarbons, the process comprising the steps of:

(a) splitting a feed gas stream into a first feed gas stream and a second feed gas stream;

(b) cooling and partially condensing the first feed gas stream to produce a cooled feed stream;

(c) separating the cooled feed stream into a first vapor stream and a first liquid stream;

(d) expanding the first vapor stream to a low pressure to produce a lower tower feed stream;

(e) supplying a fractionation tower with the lower tower feed stream, a first tower feed stream, and a second tower feed stream, the fractionation tower separating the lower tower feed stream, the first tower feed stream, and the second tower feed stream into a tower bottoms stream and a tower overhead stream;

(f) warming the tower overhead stream to produce a residue gas stream; and (g) wherein an improvement includes:

i) supplying an absorber tower containing one or more mass transfer stages with the second feed gas stream as a lower absorber feed stream;

ii) cooling the first liquid stream to form a substantially cooled first stream and supplying the absorber tower with the substantially cooled first liquid stream as a top absorber feed stream, the absorber tower producing an absorber overhead streamand an absorber bottoms stream;

cooling the absorber overhead stream so that at least a portion of the absorber overhead stream is substantially condensed to produce the first tower feed stream; and iii) maintaining quantities and temperatures of the first and second tower feed streams so that a tower overhead temperature of the tower overhead stream is maintained and a major portion of the C2 components, C3 components and heavier hydrocarbons is recovered in the tower bottoms stream.

17. The process of claim 16, wherein the improvement further includes the step of cooling the absorber bottoms stream so that at least a portion of the absorber bottoms stream is substantially condensed to produce the second tower feed stream.

18. The process of claim 16, further including the step of cooling the second feed gas stream prior to introduction into the absorber tower.

19. The process of claim 16, wherein the improvement further includes providing recovery of ethane in excess of about 96% and recovery of propane in excess of about 99.5%.

20. The process of claim 16, further including the steps of:

(a) cooling and expanding the second feed gas stream to an intermediate pressure between the feed gas pressure and the low pressure;

(b) substantially cooling and expanding at least a portion of the substantially cooled first liquid stream to the intermediate pressure; and (c) operating the absorber tower at the intermediate pressure.

21. The process of claim 16, further including the step of expanding the second condensed stream to the lower pressure and directing the expanded second condensed stream to the distillation tower at a feed location below the expanded first vapor stream.

22. The process of claim 16, wherein the steps of warming the tower overhead stream, cooling the first liquid stream, cooling and thereby substantially condensing at least a portion of the absorber overhead stream, and cooling the absorber bottoms stream are performed by heat exchange contact with a process stream selected from the group consisting of the tower overhead stream, the first liquid stream, the absorber overhead stream, the absorber bottoms stream, and combinations thereof.

23. An apparatus for separating an inlet gas stream containing methane and lighter components, C2 components, C3 components and heavier hydrocarbons into a more volatile gas fraction containing substantially all of the methane and lighter components and a less volatile hydrocarbon fraction containing a major portion of C2 components, C3 components and heavier hydrocarbons, the apparatus comprising:

(a) a first cooler for cooling and partially condensing a feed gas stream having a feed gas pressure to provide a cooled feed stream;

(b) a first separator for separating the cooled feed stream into a first vapor stream and a first liquid stream;

(c) a first expander for expanding the first vapor stream to a low pressure so that the first vapor stream forms a lower tower feed stream;

(d) a fractionation tower for receiving the lower tower feed stream, a first tower feed stream, and a second tower feed stream and for separating the lower tower feed stream, the first tower feed stream, and the second tower feed stream into a tower bottoms stream and a tower overhead stream;

(e) a first heater for warming the tower overhead stream to produce a residue gas stream;

(f) an absorber tower containing one or more mass transfer stages for receiving a second gas stream as a lower absorber feed stream;

(g) a second cooler for cooling the first liquid stream to produce a substantially condensed first liquid stream and supplying the absorber tower with the substantially condensed first liquid stream as a top absorber feed stream, the absorber tower producing an absorber overhead stream and an absorber bottoms stream; and (h) a third cooler for cooling and thereby substantially condensing the absorber overhead stream to produce the first tower feed stream.

24. The apparatus of claim 23, further including a fourth cooler for cooling the absorber bottoms stream to produce the second tower feed stream.

25. The apparatus of claim 23, further including a fifth cooler for cooling the second gas stream prior to introduction into the absorber tower.

26. The apparatus of claim 25, further including a second expander for expanding the second gas stream and at least a portion of the substantially cooled first liquid stream prior to introduction into the absorber tower.

27. The apparatus of claim 23, further comprising a first compressor for compressing the tower overhead stream prior to producing the residue gas stream.

28. The apparatus of claim 23, wherein the first heater, the second cooler, the third cooler and the fourth cooler comprise a single heat exchanger that is capable of performing each duty separately performed by each exchanger.

* * * * *